US006419413B1

(12) United States Patent
Oliver et al.

(10) Patent No.: US 6,419,413 B1
(45) Date of Patent: Jul. 16, 2002

(54) RETRACTABLE WRITING INSTRUMENT ASSEMBLY

(75) Inventors: Maria Moliner Oliver, Brooklyn; Douglas B. Leeds, New York, both of NY (US)

(73) Assignee: Thomson-Leeds Company, Inc., New York, NY (US)

( * ) Notice: Subject to any disclaimer, the term of this patent is extended or adjusted under 35 U.S.C. 154(b) by 0 days.

(21) Appl. No.: 09/776,896

(22) Filed: Feb. 6, 2001

(51) Int. Cl.[7] ..... B43K 23/02

(52) U.S. Cl. ..... 401/131; 211/69.8; 224/162; 242/406; 248/579

(58) Field of Search ..... 401/131, 88; 211/69.1, 211/69.8; 224/162; 242/310, 406; 248/579, 685

(56) References Cited

U.S. PATENT DOCUMENTS

| | | | |
|---|---|---|---|
| 245,257 | A | 8/1881 | Wright |
| 1,874,984 | A | 8/1932 | Hanskat |
| D185,331 | S | 5/1959 | Tannenbaum |
| 2,961,257 | A | 11/1960 | Carr |
| D254,856 | S | 4/1980 | Bajusz |
| 4,236,841 | A | 12/1980 | Jongeward |
| D281,174 | S | 10/1985 | Mahoney et al. |
| D299,659 | S | 1/1989 | Lantz |
| 5,123,548 | A | 6/1992 | Milne |
| D344,287 | S | 2/1994 | Johnson |
| 5,358,348 | A | 10/1994 | Kennedy |
| D352,957 | S | 11/1994 | Lehtimaki |
| 5,371,516 | A | 12/1994 | Toyoda et al. |
| 6,043,807 | A | 3/2000 | Carroll |
| 6,065,892 | A | 5/2000 | Smith |

FOREIGN PATENT DOCUMENTS

| | | | |
|---|---|---|---|
| GB | 2288150 | * 10/1995 | ..... 401/131 |
| JP | 7309093 | * 11/1995 | ..... 401/131 |

* cited by examiner

*Primary Examiner*—Gregory L. Huson
*Assistant Examiner*—Kathleen J. Prunner
(74) *Attorney, Agent, or Firm*—John H. Thomas, PC

(57) ABSTRACT

A writing instrument is attached to a cord that is itself retractable into a housing. The housing includes a spool connected to a spring. The retractable cord is connected to the spool, and the spool is adapted to wind the cord around it as a result of the spring being biased to turn the spool so the cord is wound around it. A mount connects the housing to a surface. The housing may have written indicia displaying on it. Further, the mount can be rotatably connected to the housing.

8 Claims, 5 Drawing Sheets

RETRACTABLE WRITING INSTRUMENT ASSEMBLY

This invention relates to a retractable writing instrument assembly. A pen, pencil or other marker is attached to a cord that retracts into a housing. The invention is designed to provide, but is not limited to, a point of sale assembly that conveniently supplies a writing instrument and a platform for advertising.

BACKGROUND OF THE INVENTION

It is well know to have a pen, pencil or other writing instrument on a string next to a cash register. Whether a string, chain or plastic line is used, it inevitably becomes broken or twisted or knocks over other objects on a counter surface. Nevertheless, a string is an improvement over not having a string. If there is no string, then retailers and/or customers can misplace, drop or otherwise accidentally pocket a pen that is used to sign a credit card receipt.

From an appearance standpoint, the pen-on-a-string look can look cluttered and disheveled. The pen or pencil can be broken. Further, the writing instrument may have advertising or promotional information that is undesirable or unintended. For instance, a competitor's promotional information may appear on a pen or pencil of a proprietor's establishment.

Solutions to some of these problems have been retractable pens. The pens or other writing instruments are connected to a tight spring. The spring tension becomes greater the more the string is pulled from a housing. This produces a potentially dangerous snap-back of the pen. The tight spring can also be interfere with the use of the pen that has a pull on the back end that makes writing difficult. Additionally, known retractable devices are rigidly mounted to the surface of for instance, a counter. The repeated pull of a string in a given direction may cause wear on the string and even eventually breakage. This is particularly true if the pen is to be used by both a cashier and customer pulling the pen in opposite directions.

SUMMARY OF THE INVENTION

Accordingly, it is an object of the present invention to provide a retractable writing instrument assembly that overcomes the foregoing problems. The assembly may include a constant force spring to best regulate the force of the cord and the drawing of the pen back to a housing. Also, the housing itself may include a surface for displaying written indicia such as promotional or advertising messages. Still further, the housing may include a rotatable mount to rotate the housing when the pen is withdrawn from the housing. The rotating action both draws attention to the housing (where the advertising message is) and provides relief from the stress of drawing the cord from the housing.

In one embodiment, the retractable writing assembly has a writing instrument having a first end that includes a point for writing and a second end opposite the first end. A retractable cord is attached to the second end of the writing instrument. A housing comprises a spool connected to a spring. The retractable cord is connected to the spool wherein the spool is adapted to have the cord wind around it. The spring is biased to turn the spool so that the cord is wound around it. A mount connected to the housing is adapted to attach the housing to a-surface. The assembly may further have a surface that displays written indicia. The assembly may also include a constant force spring as its spring. Still further, the assembly may have the mount rotatably connected to the housing. Still further, the housing may be in the shape of a box with the mount connected to one side of the box and the written indicia displayed on another side of the box including the opposite side of the box from the mount.

In an alternative embodiment, a retractable writing instrument assembly includes a writing instrument having a first end that includes a point for writing and a second end opposite the first end. A retractable cord is attached to the second end of the writing instrument. A housing comprises winding means for drawing the retractable cord into the housing, and mounting means attach the housing to a surface. This assembly may include a surface that displays written indicia. The mounting means may further comprise means for rotatably connecting the housing to a surface. And the winding means may comprise a constant force spring.

DETAILED DESCRIPTION OF THE PREFERRED EMBODIMENTS

The invention will be discussed in the context of a preferred embodiment. Of course alternatives and variations are envisioned, many of which are noted herein. Those of ordinary skill in the art will be able to use the teachings contained herein to design still further variations encompassed within the scope of the appended claims.

Figure 1:
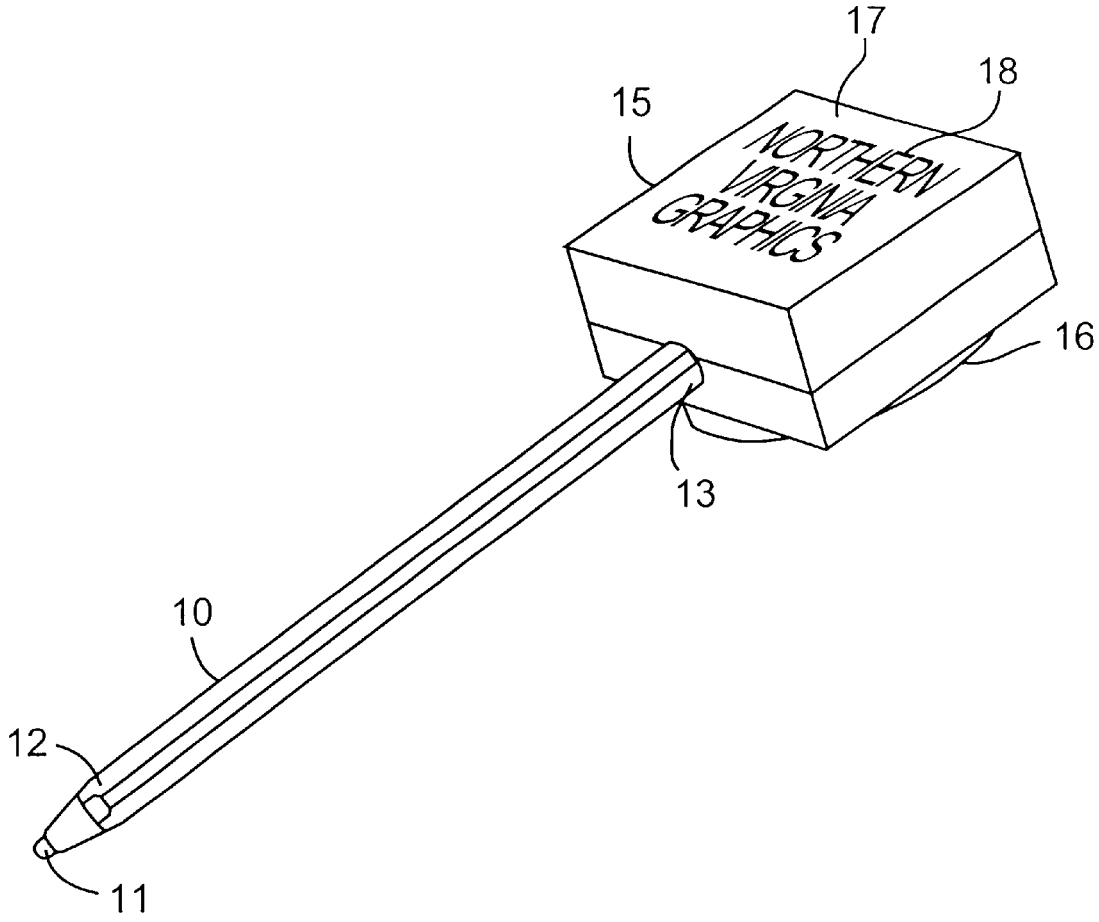
FIG. 1 is a perspective view of a preferred embodiment of the present invention wherein the pen is in the fully retracted position.

FIG. 1 displays a pen 10 shown in the fully retracted, nested position within a housing 15. The pen 10 contains a point 11 for writing. The pen 10 has a first end 12 and second end 13. The point 11 is at the tip of the first end 12. The housing 15 includes a mount 16 attached to it. The housing 15 also has a surface 17 on which is displayed written indicia 18.

Figure 2:
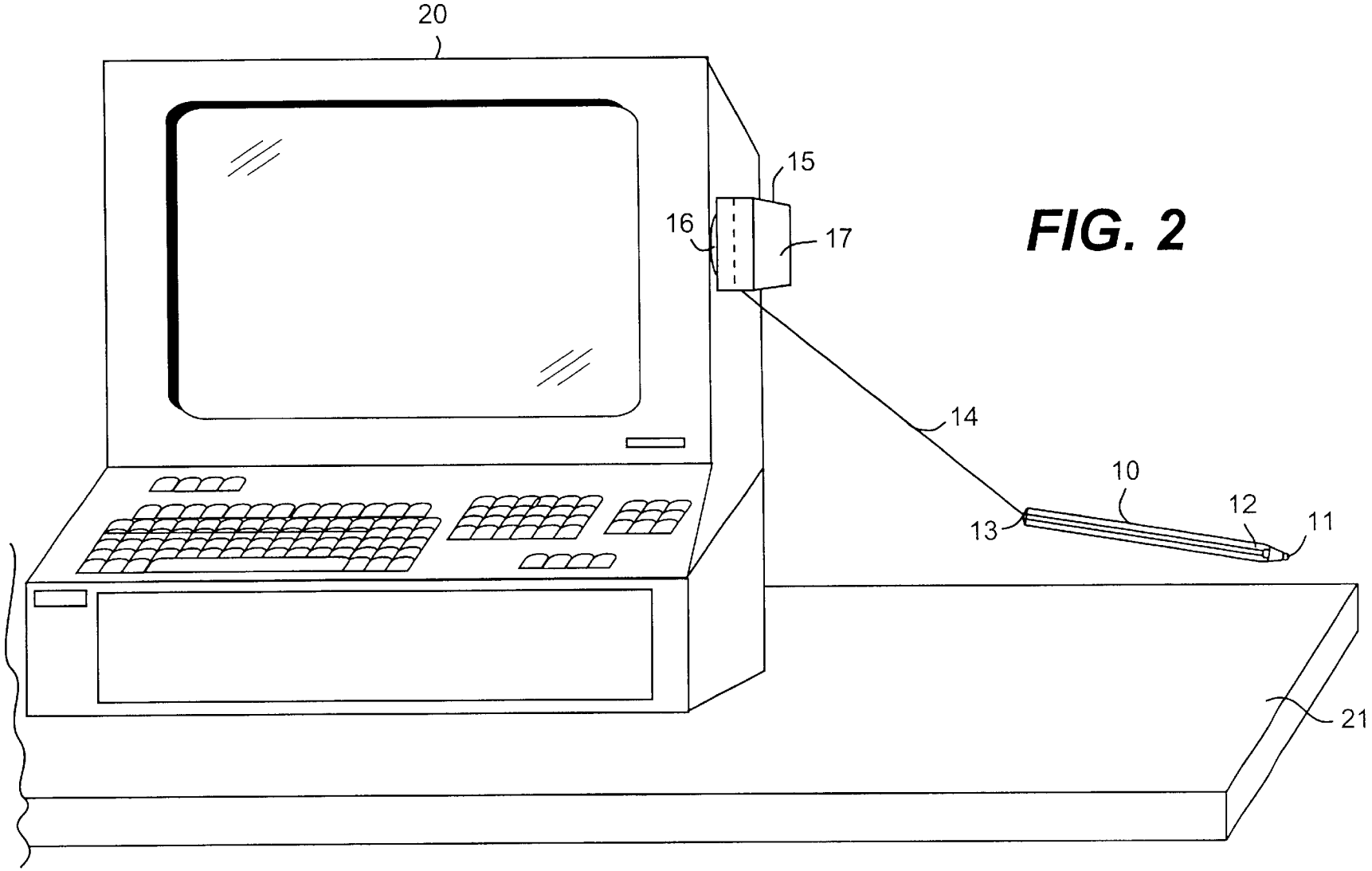
FIG. 2 is a perspective view displaying an assembly in accordance with a preferred embodiment of the present invention wherein the pen is in a partially extended position, and further wherein the assembly is mounted in an exemplary environment on a cash register resting on a counter top.

FIG. 2 illustrates the same pen 10 and housing 15 as shown in FIG. 1. In this view, the pen 10 is in an extended position wherein the cord 14 has been drawn out of the housing 15. The cord 14 is attached to the second end 13 of the pen 10. In this view, the housing 15 is attached to a cash register 20 by means of the mount 16. The cash register 20 rests on a counter 21 where, for instance, a credit card receipt may be signed by an individual using the pen 10. Obviously, the mount 16 could be attached to almost any surface as desired.

Figure 3:
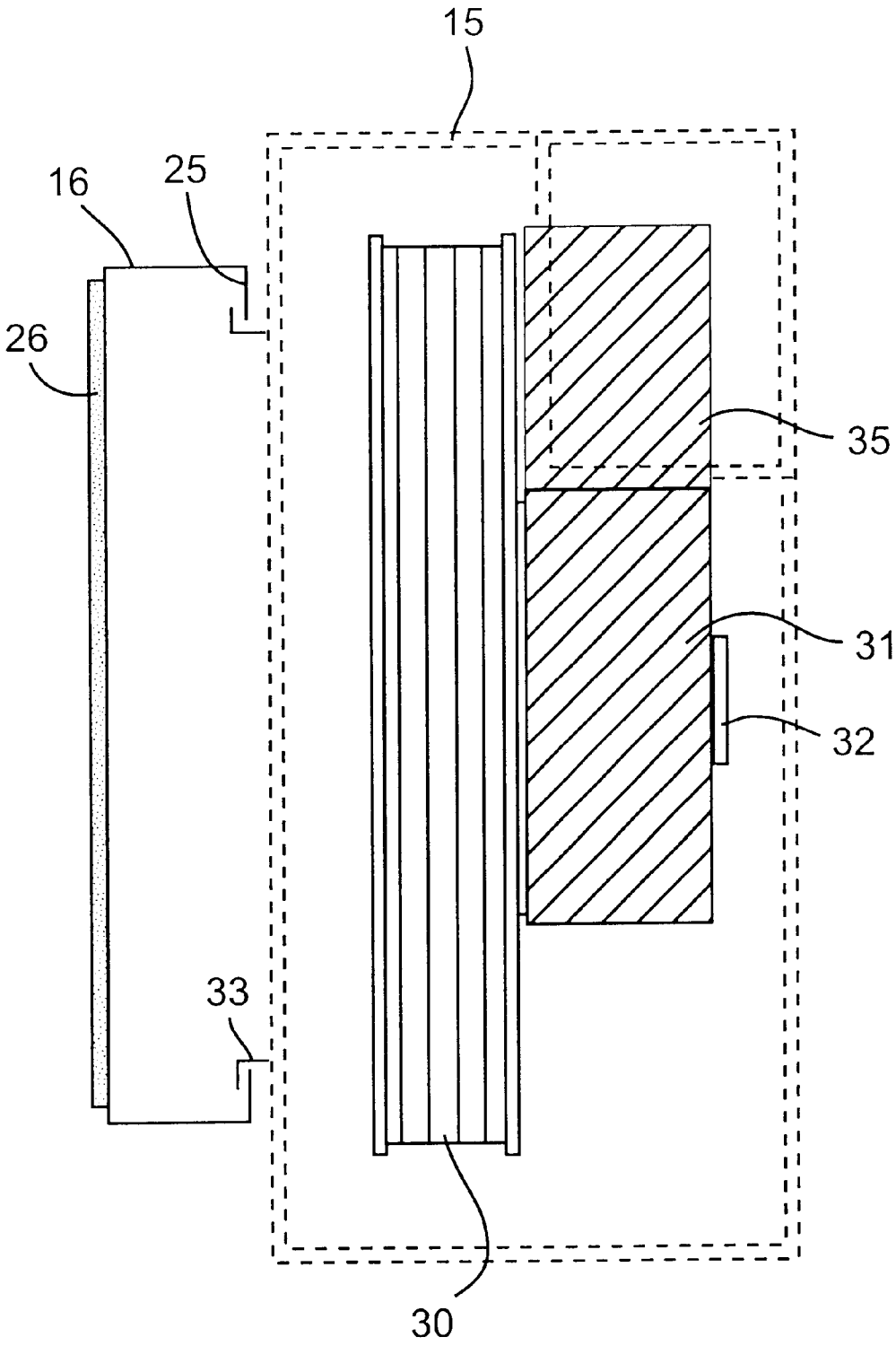
FIG. 3 is a top elevation view of the assembly with the outer housing being shown in dotted lines.

FIG. 3 is a top, cut away view of the housing 15 illustrating the inner workings of the housing. The housing 15 is essentially a plastic box. Inside the housing 15, there is a spool 30. The spool 30 is fixedly connected to a cam 31, both of which are rotatably mounted about a fixed rod 32.

There is also a spring 35. The mount 16 includes an adhesive 26 for attaching the mount to a surface such as the cash register 20 illustrated in FIG. 2. The housing 15 includes a clip 33 around which a lip 25 of the mount 16 is able to rotate. In other words, the interaction between the clip 33 and the lip 25 is adapted to be loose enough that the housing 15 may easily rotate around the mount 16.

In operation, the spool 30 is adapted to receive a cord 14 and have the cord coil around it. The cam 31 is fixed to the spool 30. The spring 35 is fixed to the cam 31. The spring 35 is biased so that when the spool 30 is wound, for instance, when a cord is pulled from the housing, then the spring wraps around the cam 31. The bias of the spring 35 is to return to its coiled position, therefore, there is a constant pressure to draw the cord and retract the pen to the housing 15.

Figure 4:
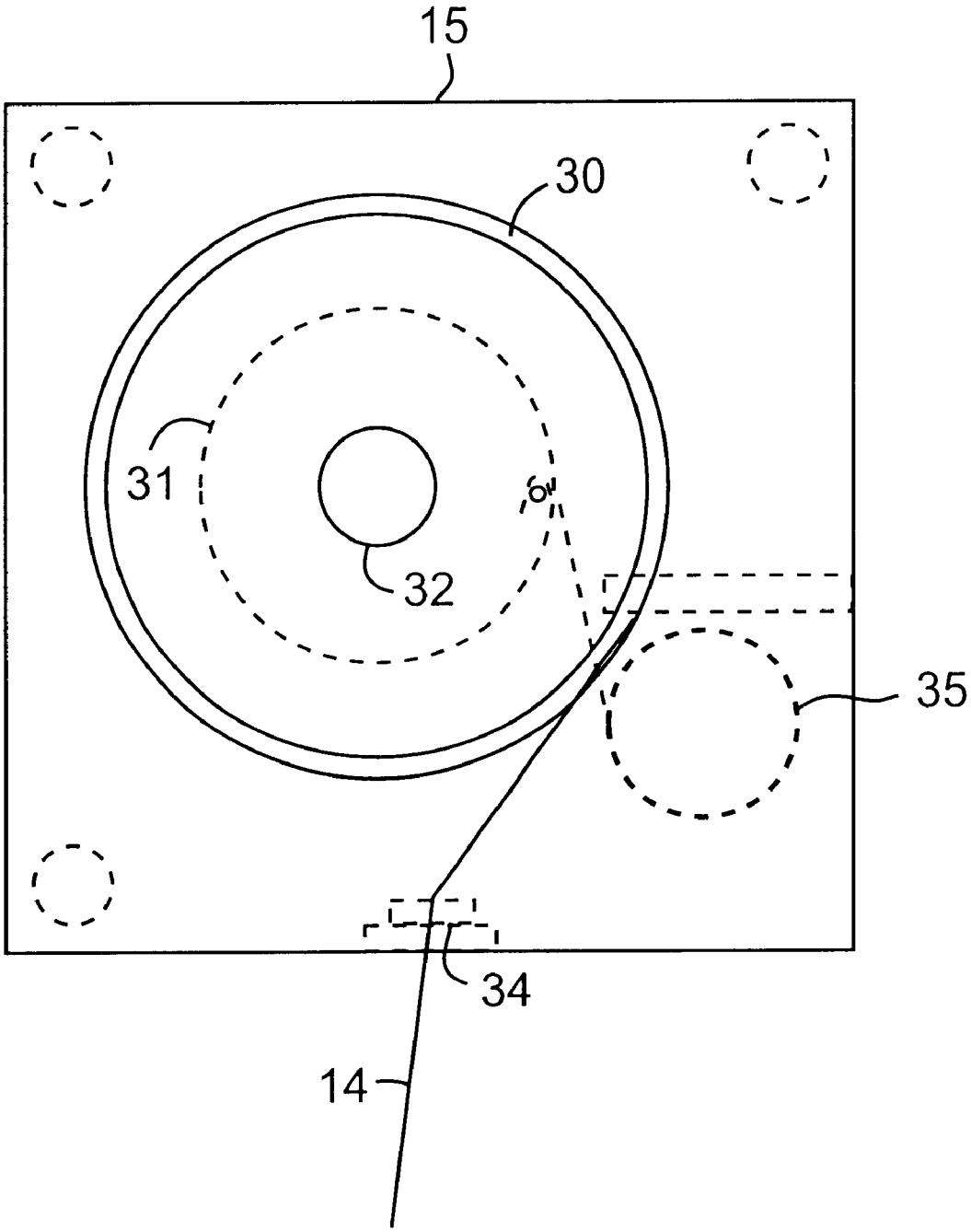
FIG. 4 is a front elevation view of a housing in accordance with the present invention wherein the winding mechanism is shown.

FIG. 4 illustrates the interaction between the spring 35 and the cam 31. As shown in FIG. 4, the cord 14 is wrapped around the outside of the spool 30. The cord 14 further extends out of the housing 15 through an eyelet 34. As shown, the eyelet 34 is slightly recessed into the housing 15. This allows the second end 13 of the pen 10 to nest or be fitted into the housing 15. The eyelet 34 may be a smooth metal ring. Alternatively, it may be made of a smooth Teflon or other plastic or any other type of material. Preferably, the eyelet 34 is rounded and smooth so that the cord 14 will not fray or become torn through repeated extension of the cord from the housing 15.

Figure 5:
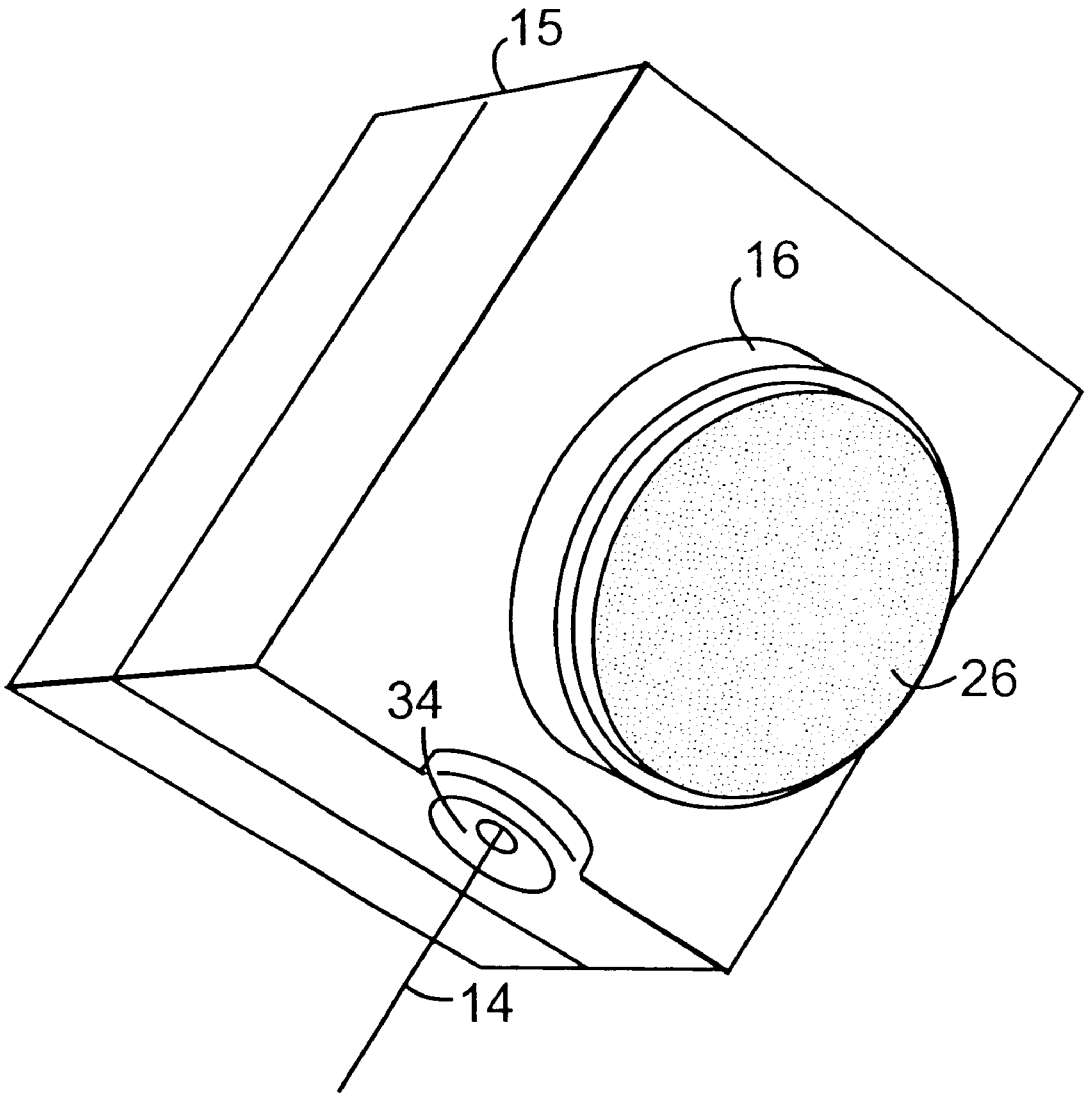
FIG. 5 is a rear perspective view of a housing in accordance with the present invention displaying a mount.

FIG. 5 illustrates a rear perspective view of the housing 15. In this view, the mount 16 and the adhesive 26 are shown clearly. Also illustrated are the recessed eyelet 34 and the extended cord 14.

The pen 10 may be substituted with any desirable writing instrument. Pencils, pens, and specific types of pens, may be necessary or desirable at any given location. A pen, and specifically, a ball point pen, is desirable in a preferred embodiment, because the ball point pen is a desirable type of pen for signing credit cards and making carbon copies.

The cord 14 may be made from any material. In the preferred embodiment, the cord is made of nylon. It is desirable that the cord be flexible and not brittle. It is also desirable that the cord not be easily tangled. With the constant unwinding and retraction into a housing, a waxed or otherwise lubricated cord could be used. As far as the length of the cord, any length may be used that is necessary for a given application. In a preferred embodiment, the cord 14 has a length between 33" and 35" when fully extended.

The preferred spring 35 used in connection with the disclosed assembly is a constant force spring. The specific type of spring may be customized to the purpose of a given assembly. It may be customized in accordance with the length of the cord and the weight of the writing instrument to be used. In the preferred embodiment, the constant force spring is made of carboned stainless steel. The "unfolded" spring has a length of 770 mm, width of 4 mm, and thickness of 0.04 mm. The exterior diameter of the folded spring is between 10.25 mm and 10.75 mm. The end of the spring has a small hook to attach to the cam. The constant force spring has a low force pull for ease of use of the writing instrument. Also, upon pulling the pen from the housing, the pen and cord would not pull the housing off of the surface that it is attached to. Further, the low force, constant force spring controls the return speed of the pen to the housing. There is no dangerous snap-back. Finally, the constant force spring helps increase the life of the cord by not making the friction. contact with the eyelet so substantially great as to cause premature wear of the cord.

The mount 16 may be adhesively attached to a surface. Alternatively, other types of attachment may be used including velcro, a magnet, a suction cup, etc. The specific means of connection between the housing 15 and the mount 16 allows the mount and the housing to be rotatably connected. If desirable, this type of connection between the mount and the housing could be a swivel type of mount, further, it could be fixed or rotatable in a limited range. In operation, when a person is using the writing instrument 10, the cord 14 will rotate the housing 15 when it is being extracted from the housing so that the cord comes straight from the eyelet 34. In this way, there is less stress on the cord 14 and on the housing 15. This feature is particularly advantageous in the setting illustrated in FIG. 2 where both the cashier and the customer may use a pen. In this way, the housing 15 will rotate backwards and forwards depending on who is using the pen. The rotation serves another purpose in that the rotation of the housing 15 when the pen 10 is removed from it draws the attention of the user to the housing. This makes the promotional message (written indicia 18) on the housing very visible and attention-grabbing.

The housing as shown in the figures is a box. As such, it presents a surface 17 on which written indicia may be applied. Written indicia means any type of color or marking or words on the housing. In other words, any type of advertising or promotional or political, etc. message may be placed on the housing. The square shape of the disclosed surface 17 also makes it easy to change or substitute the written indicia on a housing. Standardized decals could be used and appear interchangeably on the surface. In this way, different advertising campaigns or customer preferences could be periodically shown on the housing. Still further, the housing may be any shape as long as it serves the function of retracting the writing instrument. In other words, it is possible to customize the shape of the housing for promotional purposes. For instance, the housing could be in the shape of an animal or in the shape of a school mascot or corporate logo. It could be in the shape of a food item to advertise a grocery product. The potential shapes are almost endless.

It should be understood the various changes and modifications to the presently preferred embodiments described herein will be apparent to those skilled in the art. Such changes and modifications may be made without departing from the spirit and scope of the present invention and without diminishing its attendant advantages. It is therefore, intended that such changes and modifications be covered by the appended claims.

What is claimed is:

1. A retractable writing instrument assembly comprising:

a writing instrument having a first end that includes a point for writing and a second end opposite the first end, a retractable cord attached to the second end of the writing instrument;

a housing comprising a spool connected to a spring wherein the retractable cord is also connected to the spool that is adapted to wind the cord around it and wherein the spring is biased to turn the spool so that the cord is wound around it; and a mount that is rotatably connected to the housing that is adapted to attach the housing to a surface.

2. A retractable writing instrument assembly as described in claim 1, wherein the housing further comprises a surface that displays written indicia.

3. A retractable writing instrument assembly as described in claim 2, wherein the housing comprises a box, and the mount is connected to one side of the box, and the written indicia is displayed on another side of the box.

4. A retractable writing instrument assembly as described in claim 3, wherein the written indicia is displayed on the opposite side of the box from the side of the box connected to the mount.

5. A retractable writing instrument assembly as described in claim 1, wherein the spring is a constant force spring.

6. A retractable writing instrument assembly comprising:

a writing instrument having a first end that includes a point for writing and a second end opposite the first end;

a retractable cord attached to the second end of the writing instrument;

a housing comprising a spool connected to a constant force spring wherein the retractable cord is also connected to the spool that is adapted to wind the cord around it and wherein be spring is biased to turn the spool so that the cord is wound around it; and a mount connected to the housing that is adapted to attach the housing to a surface wherein the mount is rotatably connected to the housing.

7. A retractable writing instrument assembly comprising:

a writing instrument having a first end that includes a point for writing and a second end opposite the first end;

a retractable cord attached to the second end of the writing instrument;

a housing comprising winding means for drawing the retractable cord into the housing;

mounting means for rotatably attaching the housing to a surface; and wherein the housing further comprises a surface that displays written indicia.

8. A retractable writing instrument assembly comprising:

a writing instrument having a first end that includes a point for writing and a second end opposite the first end;

a retractable cord attached to the second end of the writing instrument;

a housing comprising a constant force spring for drawing the retractable cord into the housing;

mounting means for rotatably attaching the housing to a surface; and wherein the housing further comprises a surface that displays written indicia.

* * * * *